US005933470A

United States Patent [19]

Brunelle

[11] Patent Number: 5,933,470

[45] Date of Patent: Aug. 3, 1999

[54] METHOD FOR COUNTING PARTS

[75] Inventor: Steven J. Brunelle, Boise, Id.

[73] Assignee: Micron Electronics, Inc., Nampa, Id.

[21] Appl. No.: 08/958,275

[22] Filed: Oct. 27, 1997

[51] Int. Cl.[6] ..... G06M 7/00

[52] U.S. Cl. ..... 377/6; 377/8; 377/10

[58] Field of Search ..... 377/6, 8, 10

[56] References Cited

U.S. PATENT DOCUMENTS 4,217,491 8/1980 Dufford, Jr. et al. ..... 250/223 R
4,384,195 5/1983 Nosler ..... 377/53
4,481,667 11/1984 Price et al. ..... 382/65
4,807,263 2/1989 Ohno et al. ..... 377/8
5,032,715 7/1991 DeLise ..... 250/222.2
5,041,721 8/1991 Smith et al. ..... 235/462

*Primary Examiner*—Margaret R. Wambach
*Attorney, Agent, or Firm*—Dorsey & Whitney LLP

[57] ABSTRACT

The present invention comprises a method for counting a plurality of objects, wherein the objects have a discriminating aspect and are aligned such that the objects form a linear array, comprising determining the orientation of the linear array, scanning the linear array and detecting individual objects within the linear array as the linear array is scanned.

22 Claims, 13 Drawing Sheets

Y
Y=0
Y=-C
25
26
22
24
27
28
SENSOR DETECTION VECTOR 3
SENSOR DETECTION VECTOR 4

SENSOR MOVEMENT

SENSOR DETECTOR VECTOR 4
SENSOR DETECTION VECTOR 3

METHOD FOR COUNTING PARTS

This application is related to, and incorporates by reference, an application titled "A Parts Counting Apparatus" filed on even date herewith, Ser. No. 08/958,298.

BACKGROUND OF THE INVENTION

1. Field of the Invention

This invention relates generally to methods for counting objects. More particularly, this invention relates to methods for counting objects arranged in a linear array or other predetermined pattern. Specifically, this invention relates to methods for counting integrated circuit chips contained in a shipping tube that is being conveyed.

2. Description of the Prior Art

In the semiconductor industry, integrated circuit chips ("IC chips") are commonly transported within a manufacturing facility or shipped to customers in elongated shipping tubes. The IC chips are typically positioned within the shipping tubes in a stacked or end to end sequence such that the front end of one IC chip abuts the back end of the next IC chip within the shipping tube.

In many cases, it may be desirable to count the number of IC chips in a shipping tube prior to delivering the shipping tube to a customer. The customer may also desire to count the number of IC chips in a shipping tube that it receives or one that is being used in manufacturing. One method for counting IC chips within a shipping tube is to manually count the IC chips. The manual counting process is, however, slow and subject to error. Another similar method is to visually count the IC chips within the shipping tube (which is typically comprised of a transparent or substantially transparent material). This method is also slow and generally subject to more error than the manual counting process.

Stationary photoelectric or inductive proximity sensor systems provide yet another method for counting the IC chips in a shipping tube. In these systems, the shipping tube containing IC chips is transported or conveyed through the detection zone of the particular sensor. As the shipping tube is conveyed through the detection zone, the sensor successively detects a particular discriminating aspect of each individual IC chip, thereby counting the IC chips as the shipping tube is transported. While this method is generally faster and less subject to error than the manual or visual counting methods, there are some limitations. Initially, because the sensors are stationary, the detection zone of the sensor will be a point on the particular transport means. Thus, to obtain a correct count, the particular discriminating aspect of each and every IC chip in the shipping tube must pass through this point on the transport means. Accordingly, transport apparatus, such as that disclosed in U.S. Pat. No. 5,041,721, must typically be used to ensure that the particular discriminating aspect of each and every IC chip within a shipping tube passes within the point detection zone of the stationary sensor. If such stationary sensor systems and the required transport apparatus are positioned in an X-Y plane, with the Y axis being the transport direction of the transport apparatus, and the point detection zone falling on the Y axis (i.e., the line wherein X is equal to 0), it is clear that a skew of the shipping tube relative to the Y axis may result in the particular discriminating aspect of one or more of the IC chips within the shipping tube not being transported through the point detection zone of the sensor. Additionally, transport apparatus, such as the apparatus disclosed in U.S. Pat. No. 5,041,721, are relatively expensive to construct.

Furthermore, such transport apparatus may have little utility other than for use in a stationary sensor counting system. For example, the transport apparatus may be unusable as an apparatus to convey shipping tubes containing IC chips through an automated shipping tube packaging apparatus.

Thus, there exists a need for a method and apparatus for counting IC chips within a shipping tube, wherein the shipping tube may be transported on conventional transport apparatus, such as a conveyor belt, and wherein the shipping tube may be skewed with respect to the X and Y axis of the transport apparatus.

SUMMARY OF THE INVENTION

The present invention comprises a method for counting a plurality of objects, wherein the objects have a discriminating aspect and are aligned such that the objects form a linear array, comprising determining the orientation of the linear array, scanning the linear array and detecting individual objects within the linear array as the linear array is scanned.

DETAILED DESCRIPTION

System Overview

Figure 1A:
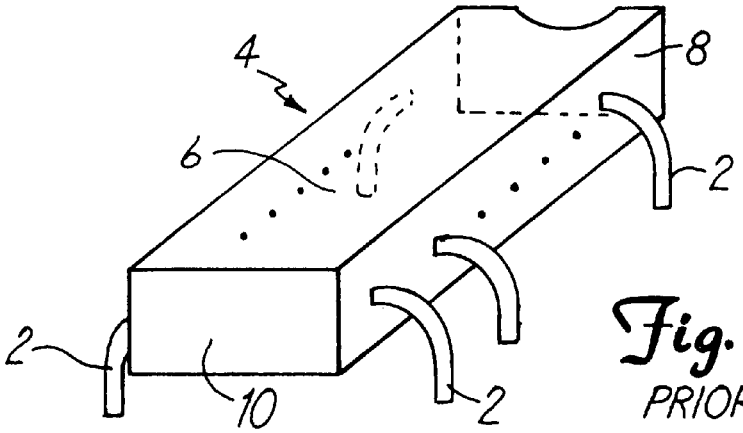
Fig. 1A PRIOR ART
FIG. 1A is a perspective view of an exemplary IC chip as known in the art.
Figure 1B:
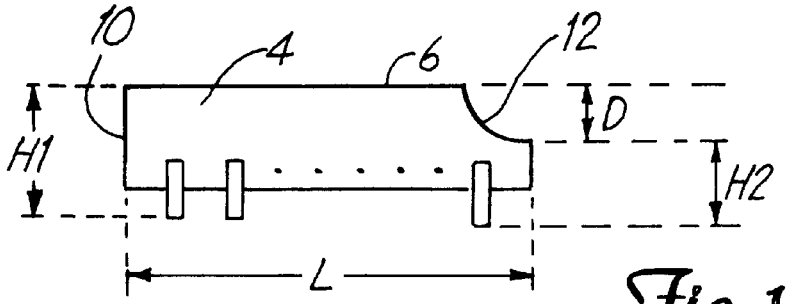
Fig. 1B PRIOR ART
FIG. 1B is a side view of an exemplary IC chip as known in the art.
Figure 1C:
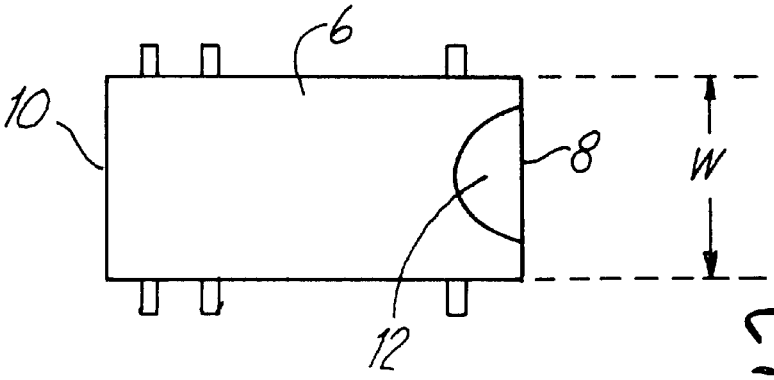
Fig. 1C PRIOR ART
FIG. 1C is a top view of an exemplary IC chip as known in the art.

Referring to FIGS. 1A–C, there is shown a typical IC chip. The IC chip is generally comprised of a plurality of legs 2 and a body 4 having an upper surface 6, a front end 8, a back end 10 and a recessed portion 12 on the upper surface 6. The recessed portion 12 of the upper surface 6 has a maximum depth D relative to the upper surface 6. The IC chip has a length L, a width W, a height H1 to the upper surface 6 and a height H2 to the recessed portion 12 (both heights being measured from the bottom of legs 2).

Figure 1D:
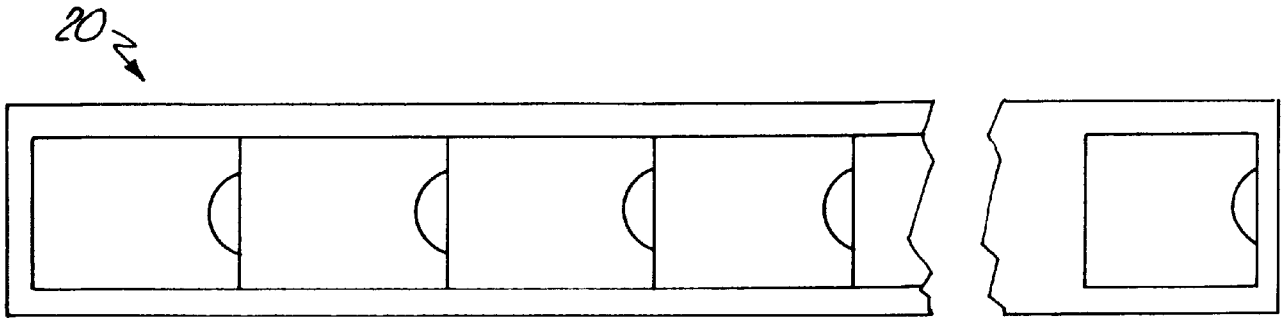
Fig. 1D PRIOR ART
FIG. 1D is a top view of a shipping tube containing IC parts as known in the art.
Figure 1E:
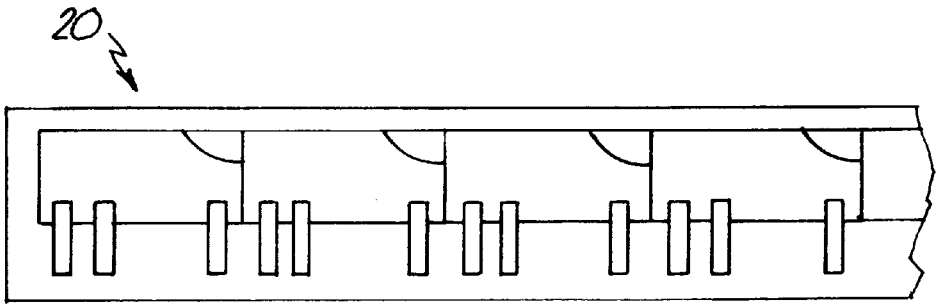
Fig. 1E PRIOR ART
FIG. 1E is a side view of a shipping tube containing IC parts as known in the art.
Figure 1F:
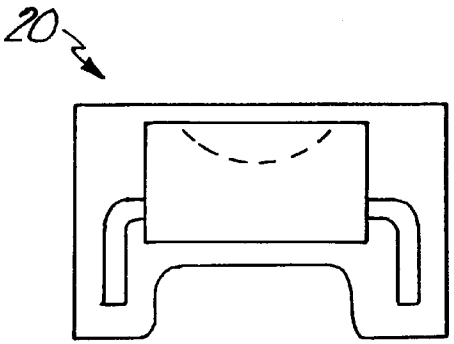
Fig. 1F PRIOR ART
FIG. 1F is a rear view of a shipping tube containing IC parts as known in the art.

Referring to FIGS. 1D–F, there is shown a shipping tube, referred to generally as 20, for shipping a plurality of IC chips. The shipping tube 20 is generally comprised of a transparent or substantially transparent plastic. As shown in FIGS. 1D–F, the width and height of shipping tube 20 are designed to substantially conform to the dimensions of a typical IC chip. Thus, the height of the shipping tube 20 is approximately equal to the height H of the IC chip, and the width of the shipping tube 20 is approximately equal to the width W of the IC chip. The length of the shipping tube 20 is approximately equal to the number of IC chips in a full shipping tube 20 multiplied times the length L of an IC chip. As shown in FIGS. 1D–E, in general, the IC chips are packaged and contained within the shipping tube 20 such that the front end 8 of an IC chip abuts the back end 10 of the next sequential IC chip.

As discussed, it may be desirable to transport the shipping tubes 20 containing IC chips through the detection zone of a sensor using conventional transport means or apparatus, such a conveyor belts. In an X-Y plane, such transport apparatus may have a width along the X axis, while the transport direction is along the Y axis. The shipping tubes 20 may be rapidly placed upon the transport apparatus by mechanical or manual means such that each shipping tube is generally oriented lengthwise across the transport apparatus, i.e., along the X axis of the X-Y plane.

Figures 2A, 2C, 2D:
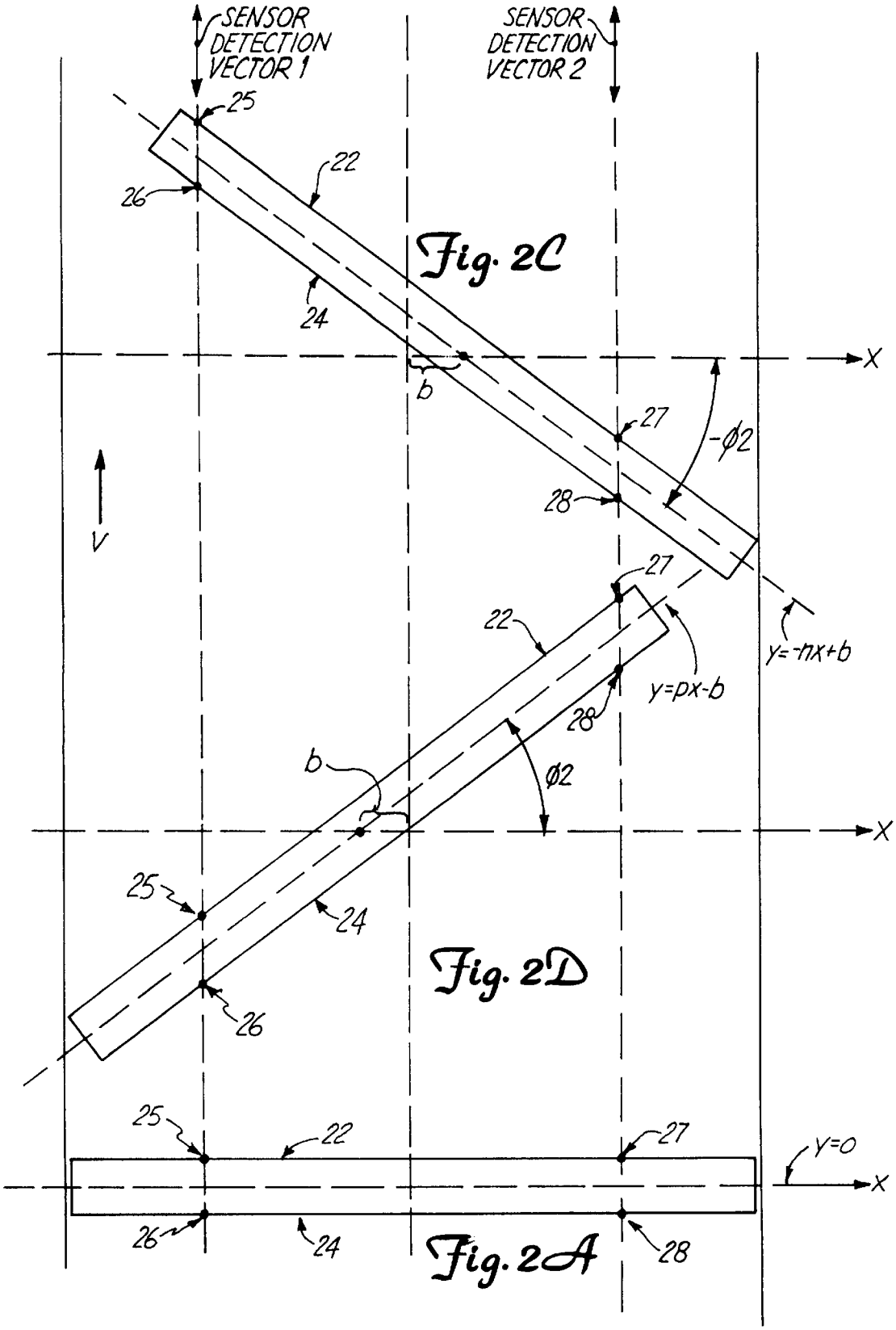
FIGS. 2A–2D are top views of a shipping tube being conveyed in an X-Y plane with differing orientations relative to the direction of conveyance.

Referring now to FIGS. 2A–D, there are a variety of manners in which the shipping tube 20 may be oriented in the X-Y plane on the transport apparatus. In FIG. 2A, the shipping tube 20 is shown oriented along the X axis of the X-Y plane such that the slope of the linear array formed by the shipping tube 20 relative to the X axis, i.e., the slope of the linear array formed by the IC chips relative to the X axis, is equal to zero. Additionally, the midpoint of the linear array formed by the shipping tube 20 is located on the Y axis. Thus, the linear array formed by the shipping tube 20 may be said to be characterized by a line having an equation $Y=0$.

Figure 2B:
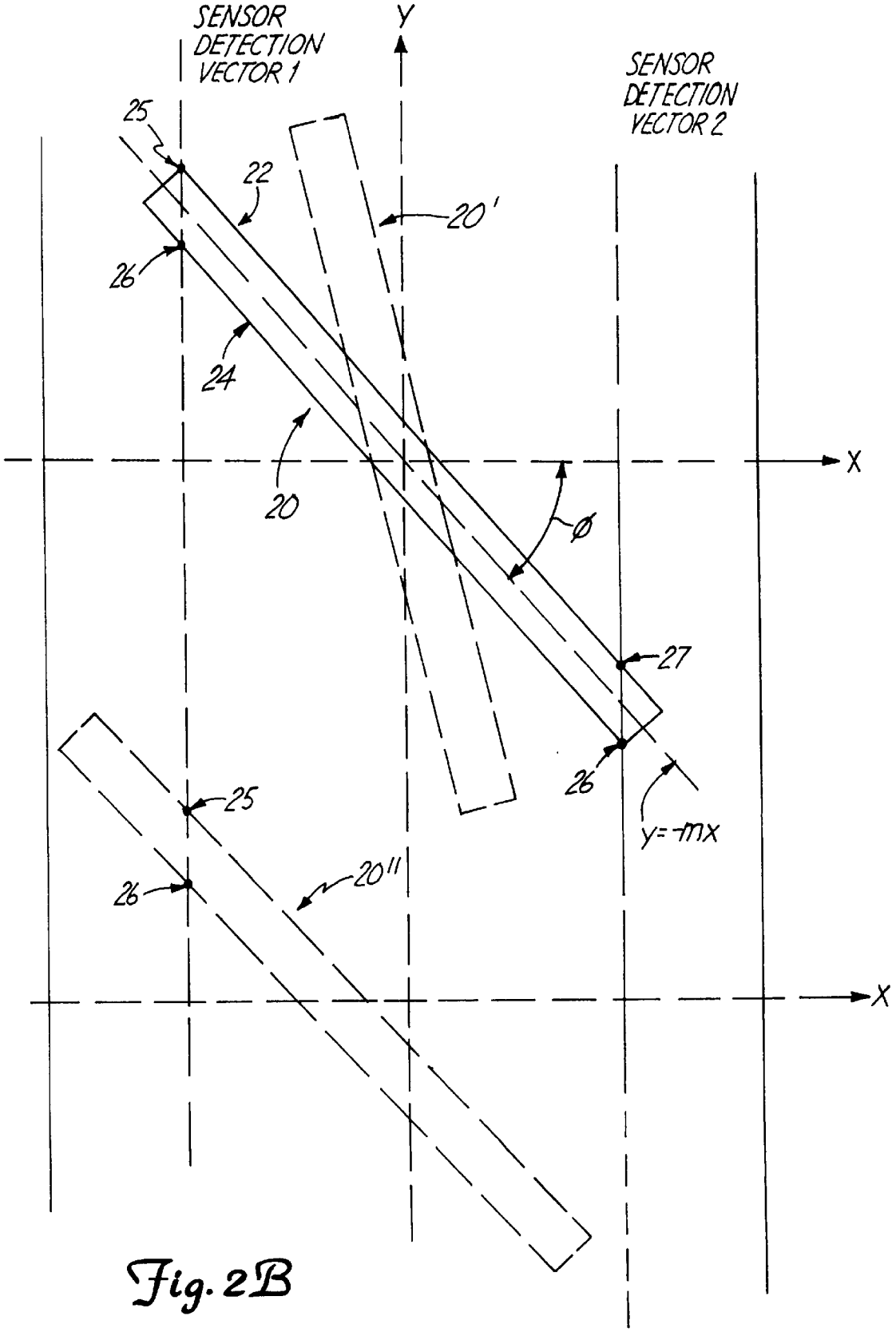

Some shipping tubes 20, however, may be skewed relative to the X and Y axes such that the linear array formed by the shipping tube 20 forms an angle $\phi$ with the X axis. This angle is generally referred to as the skew angle. In FIG. 2B, the shipping tube 20 is shown oriented in the X-Y plane such that the slope of the linear array formed by the IC chips is equal to a negative constant m. The linear array formed by the IC chips forms a negative angle $\phi 1$ with the X axis. As in FIG. 2A, the midpoint of the linear array formed by the IC chips is also located on the Y axis. Thus, the linear array formed by the IC chips may be said to be characterized by a line having an equation $Y=-mX$.

In FIG. 2C, the shipping tube 20 is shown oriented in the X-Y plane such that the slope of the linear array formed by the IC chips is equal to a negative constant n. As such, the linear array formed by the IC chips forms a negative angle $\phi 2$ with the X axis. Additionally, the midpoint of the linear array formed by the IC chips is displaced from the Y axis by a positive distance b along the X axis. Thus, the linear array formed by the IC chips may be said to be characterized by a line having an equation $Y=-nX+b$.

In FIG. 2D, the shipping tube 20 is shown oriented in the X-Y plane such that the slope of the linear array formed by the IC chips is equal to a positive constant p. As such, the linear array formed by the IC chips forms a positive angle $\phi 2$ with the X axis. Additionally, the midpoint of the linear array formed by the IC chips is displaced from the Y axis by a negative distance b along the X axis. Thus, the linear array formed by the IC chips may be said to be characterized by a line having an equation $Y=pX-b$.

It can be seen in FIGS. 2A–D and 3A–B that, given the width W of the IC chips, the shipping tube 20 (or the alignment of IC chips) will have a leading edge 22 and trailing edge 24 as the shipping tube 20 is transported in the positive Y direction.

Sensor and Related Systems

Figure 3A:
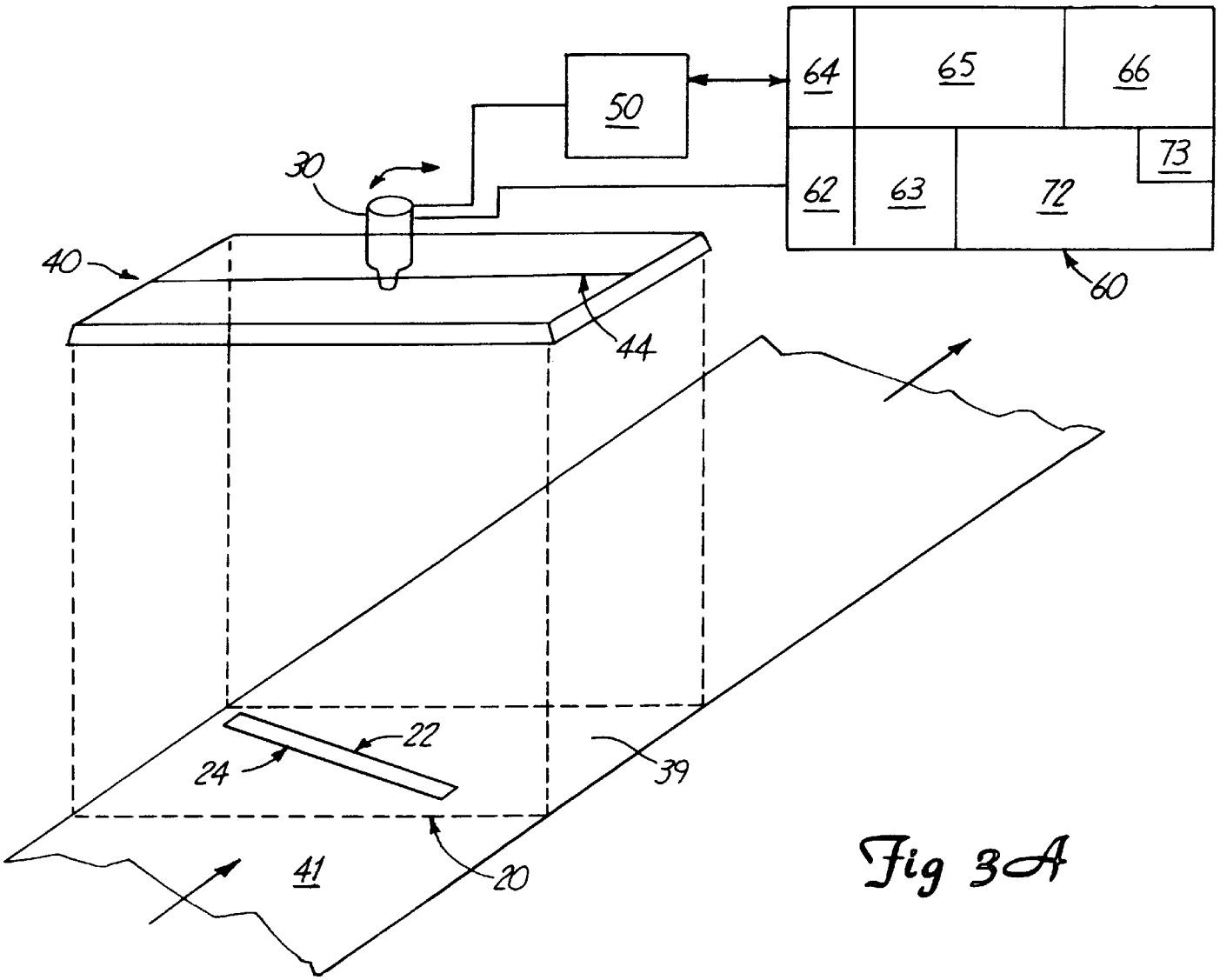
FIG. 3A is a schematic diagram of one embodiment of the present invention utilizing a moving sensor.

Referring now to FIG. 3A, there is shown an embodiment of the invention for counting the number of IC chips within a shipping tube 20. Generally, the device shown in FIG. 3A, comprises a sensor 30, an X-Y plane bridge structure 40, a sensor location controller 50 and a processor 60.

Figures 4A, 4B:
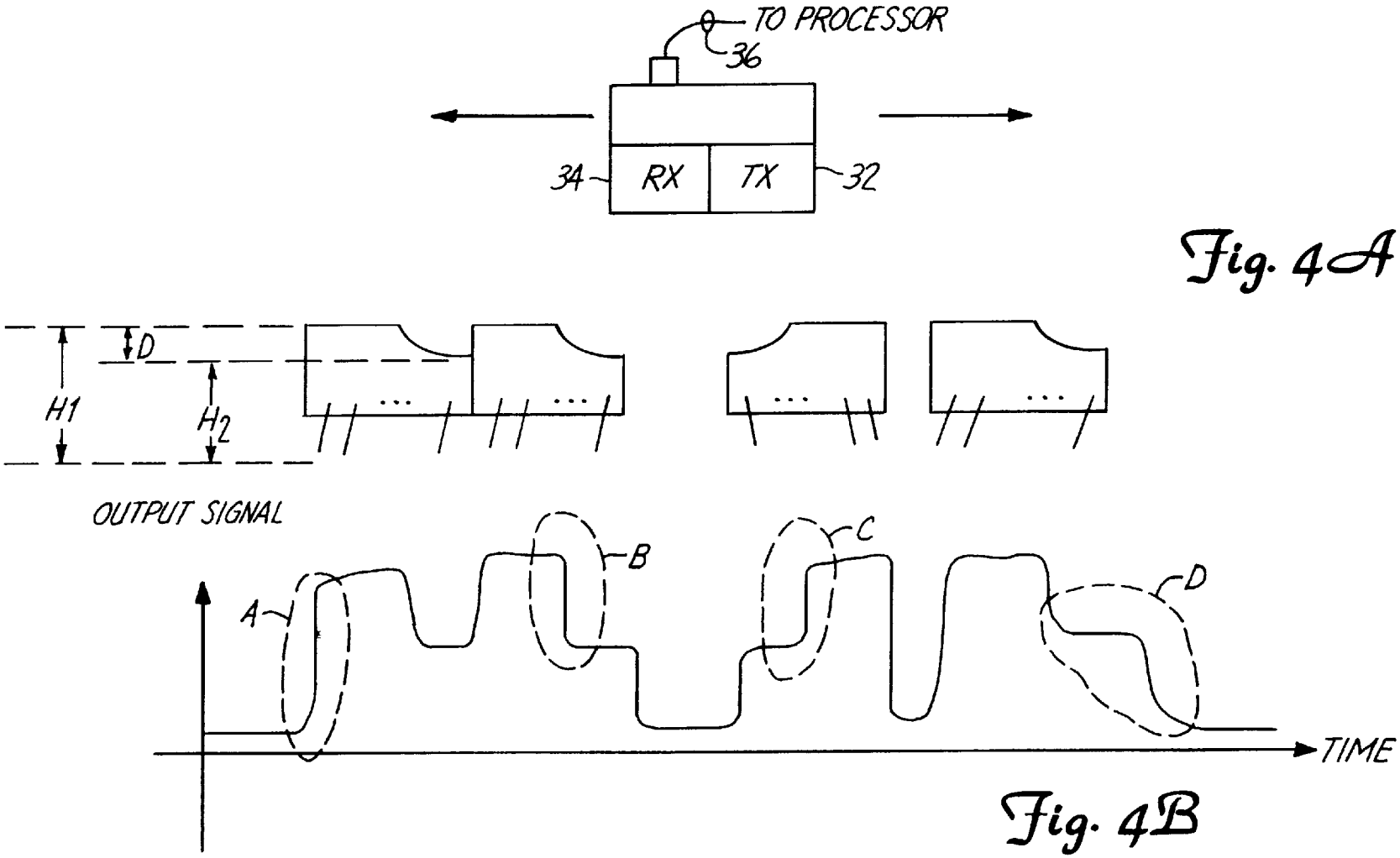
FIG. 4A is a schematic diagram of the sensor of one embodiment of the present invention, shown scanning a linear array of IC chips.
FIG. 4B is an example of a analog output signal from the sensor as it scans a linear array of IC chips, shown in correspondence to the output signal.

Referring now to FIG. 4A, the sensor 30 may be a conventional photoelectric proximity sensor comprising a transmitter 32, a receiver 34 and a signal output 36. For example, the sensor 30 may use a beam of laser or other light that can be detected according to greater or lesser degrees of reflection. A model WT-24 sensor from SICK Optic of Eden Prairie, Minn. may be used. However, other conventional sensors utilizing a variety of sensing or detecting techniques may be used. In general, light is directed towards the IC chip by the transmitter 32, reflected off of (and/or absorbed by) (1) the upper surface 6 of an IC chip, (2) the recessed portion 12 of the IC chip or (3) the surface of the underlying transport apparatus, with the reflected light received by the receiver 34. As shown in FIG. 4B, the sensor 30 may output an analog signal at the output 36. The sensitivity of the sensor 30 may be such that the sensor 30 is able to detect (1) the proximity of the sensor 30 relative to the upper surface 6 of a typical IC chip, (2) the proximity of the sensor 30 relative to the recessed portion 12 of the IC chip and (3) the proximity of the sensor 30 relative to the surface of the underlying transport apparatus. Thus, the sensor 30 of FIG. 4A will detect a difference in proximity of distance D and H2 (as shown in FIG. 1B). Alternatively, the sensor 30 may detect the edges of upper surface of the IC chip.

Referring again to FIG. 4B, the analog signal output 36 of the sensor 30 may represent these relative proximities or edges (i.e., discriminating aspects) of an IC chip. For example, signal portion A represents the relative increase in proximity of the upper surface 6 of an IC chip as opposed to the surface of the underlying transport apparatus. Signal portion B represents the relative decrease in proximity of the recessed portion 12 of the IC chip as opposed to the upper surface 6 of the IC chip. Similarly, signal portion C represents the relative increase in proximity of the upper surface 6 of the IC chip as opposed to the recessed portion 12 of the IC chip. Finally, signal portion D represents the relative decrease in proximity of the recessed portion 12 of the IC chip as opposed to the surface of the underlying transport apparatus. Clearly, various other relative increases and decreases in proximity within the sensitivity range of sensor 30 may be detected and represented by the analog signal output 36.

Figure 3B:
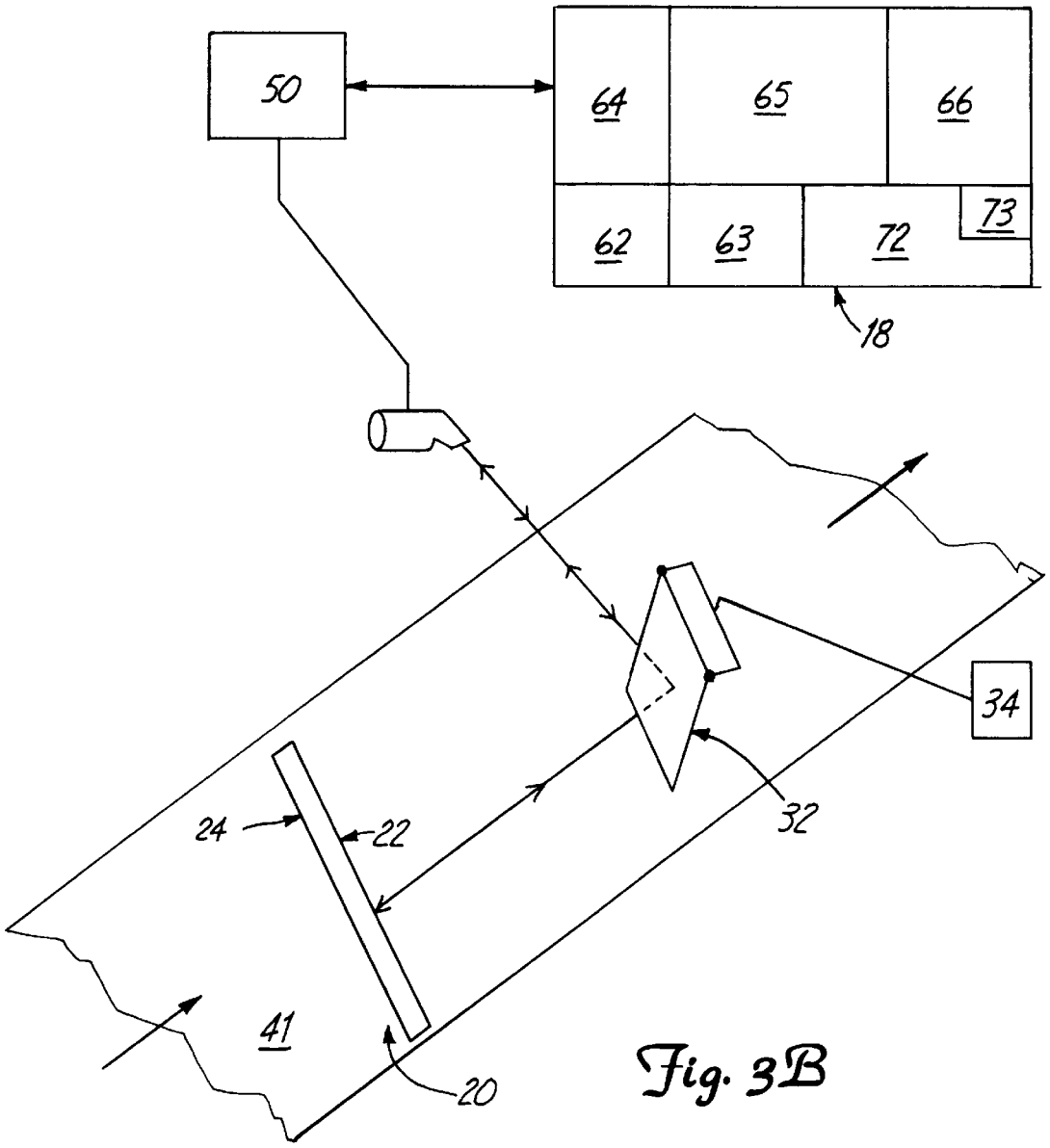
FIG. 3B is a schematic diagram of one embodiment of the present invention utilizing a Stationary sensor and light re-directing surfaces sensor.

Referring again to FIG. 3A, the X-Y bridge structure 40 generally comprises a conventional mechanical transport structure that encompasses the area in an X-Y plane defining a scanning station 39 on the transport bed 41, over which the sensor 30 may travel in order to perform the scanning and detection functions for the IC chips contained in the shipping tubes 20. The sensor 30 may be moved within the X-Y bridge structure to scan the X-Y plane of the scanning station 39 via control signals sent by the X-Y plane location controller 50 to the sensor transport 44 operably connected to the sensor 30 and the X-Y bridge structure 40. Thus, the sensor transport 44 may move the sensor 30 within the X-Y bridge structure 40 plane. The transport means 44 may be selected to be at least one or two orders of magnitude faster than the motion of the transport bed 41, to male motion of the shipping tubes 20 a negligible factor in position measurements by sensor 30. Alternatively, as shown in FIG. 3B, the sensor 30 may remain stationary and one or more light reflecting or re-directing surfaces 32, such as mirrors, may be utilized to direct the sensor's laser or light beams. The light re-directing surfaces may be moveable or rotatable in accordance with the present invention by mirror moving means 34. For simplicity, the remaining detailed description will only discuss embodiments of the invention comprising a moving sensor 30, however, embodiments of the invention comprising the stationary sensor 30, light re-directing surfaces 32 and mirror moving means 34 are within the scope and spirit of the present invention.

The processor 60 may comprise a sensor input interface 62, a signal discriminator 63, a X-Y location controller interface 64, X-Y plane memory map 66, control software 65 and a microcontroller 72. The microcontroller 72 may include an incrementable item counter 73. The signal discriminator 63 functions to discriminate, for example, between the signal portions A–D shown in FIG. 4B. Thus, the signal discriminator 63 may distinguish or discriminate between signal portion A and signal portion C. In this manner, the recessed portion 12 of an IC chip may be utilized as a discriminating aspect of a particular IC chip. In general, the microcontroller 72 executes control software 65 and controls the entire system. The interoperation of the components of this embodiment of the present invention will be described further herein.

First Embodiment

According to one embodiment, the counting of the IC chips within a shipping tube 20 may be generally outlined as follows:

1. The sensor 30 is positioned in at least two positions within the X-Y plane, such that it may be determined whether a shipping tube 20 is oriented in the X-Y plane with a positive slope, negative slope or zero slope and such that the slope of the linear array formed by the shipping tube 20 may be determined.

2. The processor 60 determines whether the shipping tube 20 is oriented in the X-Y plane with a positive slope, negative slope or zero slope.

3. The processor 60 calculates the slope of the shipping tube 20.

4. The sensor 30 is disposed towards an end point of the shipping tube 20.

5. The sensor 30 scans along the slope of the shipping tube 20, wherein IC chips within the shipping tube 20 are detected and counted as the slope of the shipping tube 20 is scanned over the entire length of the shipping tube 20.

Figure 5A:
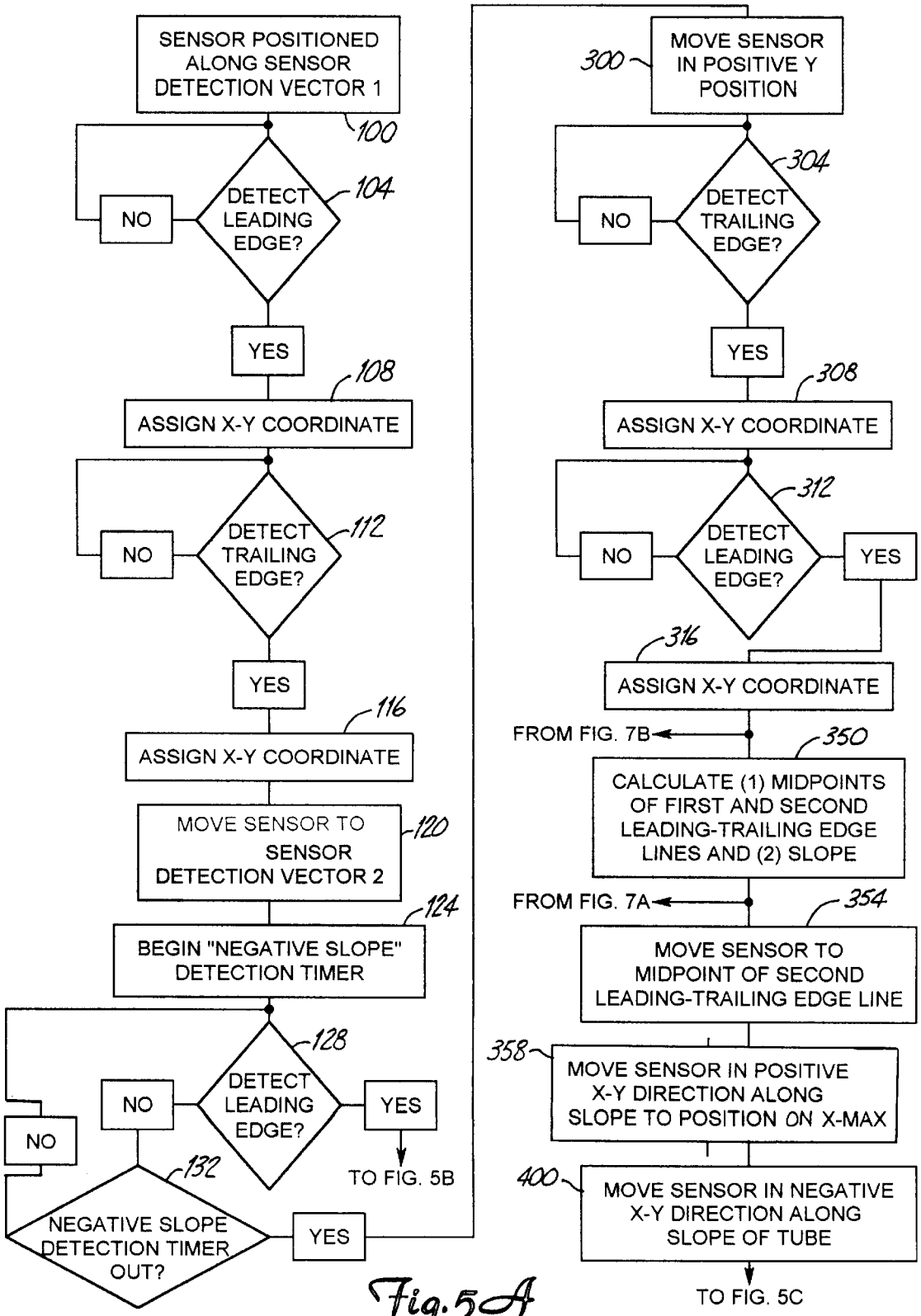
FIGS. 5A–C are flow charts detailing the process for counting; IC chips for one embodiment of the present invention.
Figure 5B:
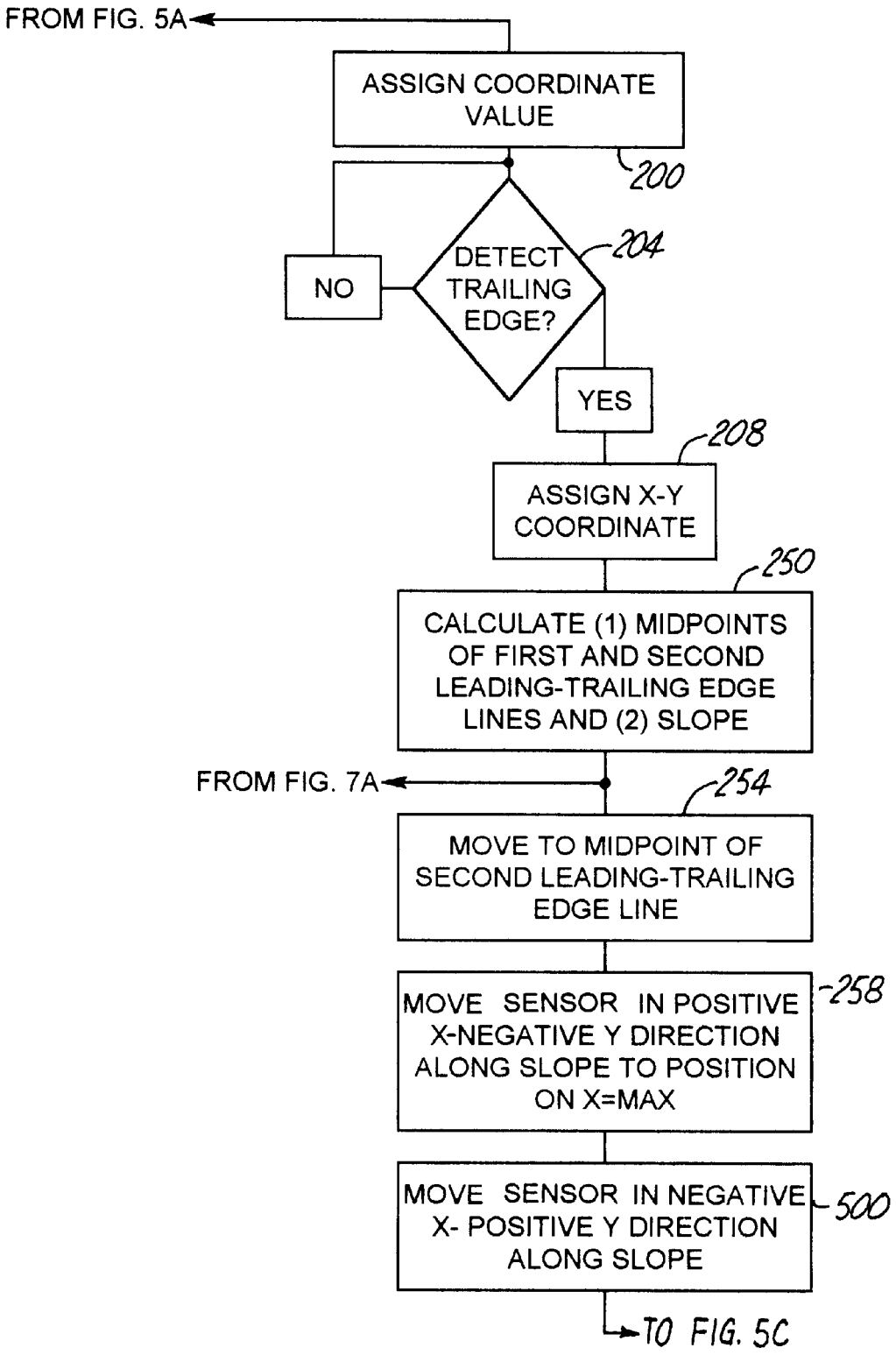
Figure 5C:
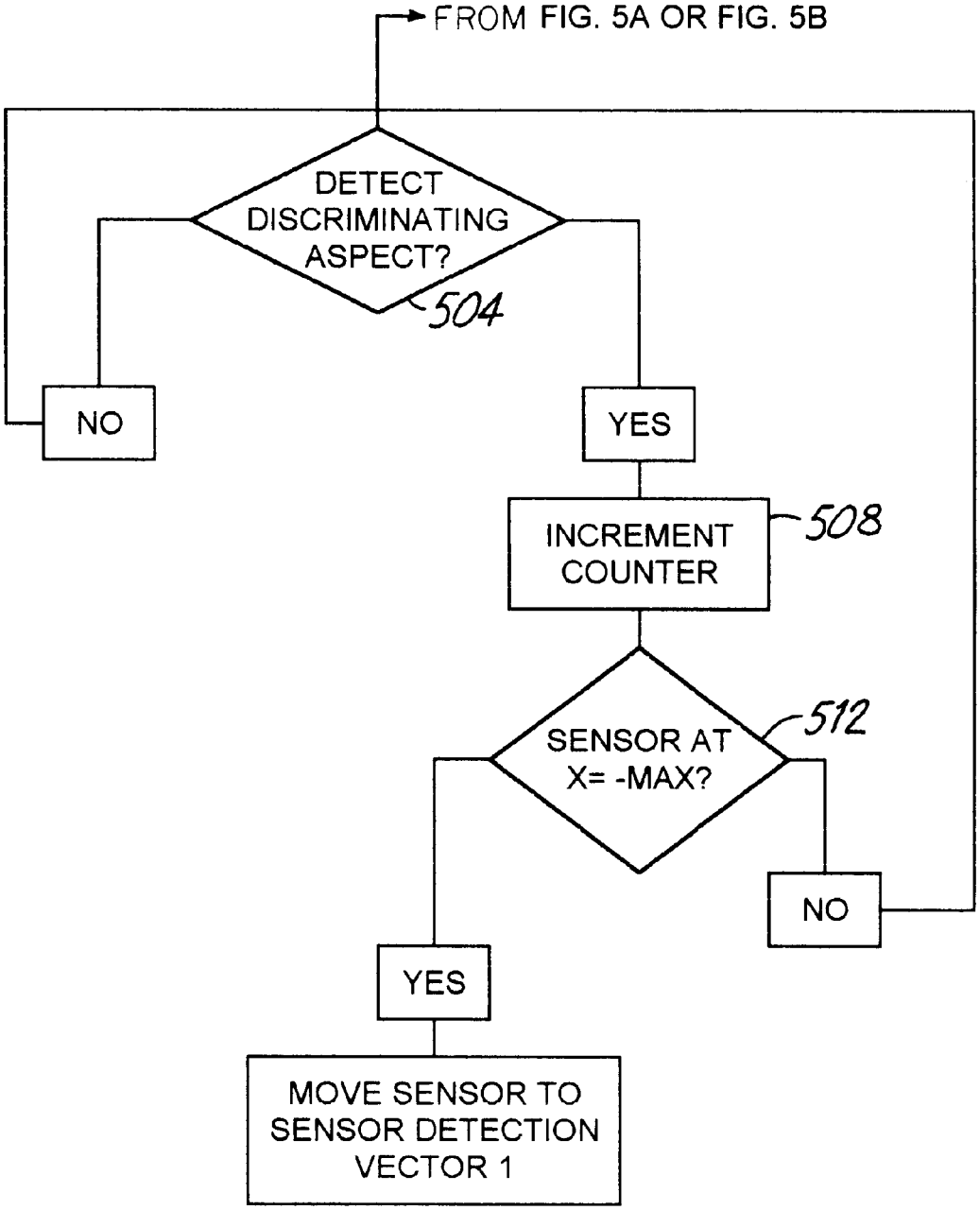

Referring now to FIGS. 2A–D, 3A, 4A–B and 5A–C, the counting of the IC chips within a shipping tube 20, as outlined above, will now be described in detail. Specifically, FIGS. 5A–C show a detailed flow chart of the steps outlined above.

Positioning the Sensor

In order to determine the slope of the shipping tube 20 in the X-Y plane (i.e., the slope of the linear array formed by the IC chips linearly aligned within the shipping tube 20), at least two points on the linear array formed by the IC chips are determined as the linear array is conveyed in the Y direction. X-Y plane coordinate values are then assigned to the determined points. As shown in FIGS. 2A–D, and in block 100 of FIG. 5A, in order to determine these points on the linear array, the sensor 30 is positioned along Sensor Detection Vector 1 until a first leading edge point 25 and a first trailing edge point 26 on the shipping tube 20 are detected. The sensor 30 is then positioned along Sensor Detection Vector 2, along which a second leading edge point 27 and second trailing edge point 28 may be detected. Sensor Detection Vector 1 and Sensor Detection Vector 2 are located on opposite sides of the Y axis and may be characterized by lines having an equation X=−K; and X=K, respectively.

As can be seen in FIGS. 2A–D, the lines characterizing the Sensor Detection Vectors 1 and 2 may be calculated or determined based upon the maximum likely skew angle $\phi$ formed by the linear array of IC chips and the X axis, and by the maximum likely displacement b of the midpoint of the linear array of IC chips from the Y axis. For example, in FIG. 2B, if the shipping tube 20 is skewed at a greater angle to the X axis (as shown in phantom and referenced as 20'), the first and second leading and trailing edge points 25, 26, 27 and 28 of the shipping tube 20 will not intersect Sensor Detection Vectors 1 and 2. Similarly, in FIG. 2B, if the midpoint of the linear array of the IC chips is displaced at a certain distance from the Y axis and skewed at a certain angle (also shown in phantom and referenced as 20"), at least one pair of leading and trailing edge points (i.e., the first or second leading and trailing edge points, and in this case the second leading and trailing edge points) of the shipping tube 20 will not intersect the Sensor Detection Vectors 1 and 2.

Thus, in this embodiment, in order to determine at least two points on the linear array formed by the IC chips as the linear array is conveyed in the Y direction, the sensor 30 will be positioned along the Sensor Detection Vectors 1 and 2. In this manner, the number of IC chips in a shipping tube 20 with a maximum skew angle $\phi$ and a maximum midpoint displacement b may be counted. In general, the greater the maximum skew angle $\phi$ and the greater the maximum midpoint displacement b (both of which may be determined by the manner in which the tubes 20 are placed on the transport bed 41 and a variety of other factors), the closer that Sensor Detection Vectors 1 and 2 must be to the Y axis. However, placing the Sensor Detection Vectors 1 and 2 relatively close together may result in shipping tubes 20 oriented and positioned in side areas of the transport bed 41 not being detected. Clearly, a compromise based on tube length, maximum allowable skew angle, maximum allowable midpoint displacement and the width of transport bed 41 must be made, allowing most shipping tubes 20 to intersect Sensor Detection Vectors 1 and 2.

Determining Whether the Slope is Negative or Positive

Referring now to FIGS. 5A–C, in block 100, the sensor 30 is positioned along Sensor Detection Vector 1. Shipping tubes 20 containing IC chips are transported by a transport apparatus such that the first and second leading and trailing edge points 25, 26, 27 and 28 will intersect the Sensor Detection Vectors 1 and 2 respectively. At block 104, when a first leading edge point 25 of a shipping tube 20 is detected (i.e., when the relatively closer proximity of the upper surface 6 or recessed portion 12 of an IC chip is distinguished from the surface of the transport bed 41), at block 108 the processor 60 assigns a coordinate value in the relative X-Y plane of (X=−K, Y=0) to this detection point. The coordinate is stored in the X-Y plane memory map 66. This point may be considered the Y axis reference point. Henceforth, for purposes of the memory map 66, the line characterized by the equation Y=0 travels in the positive Y direction at the transport velocity of the transport bed 41. At block 112, the sensor then waits until a first trailing edge point 26 of the shipping tube 20 is detected. (The system may have a Trailing Edge Alarm timer triggered by the detection of the first leading edge point 25 and encompassing the time in which a first trailing edge point 26 would be expected to enter the detection zone of the sensor 30. If the Trailing Edge Alarm timer expires without the detection of the first trailing edge point 26, the system may enter an alarm mode; e.g., the transport apparatus may have stopped, etc.).

Returning to block 112, when a first trailing edge point 26 of the shipping tube 20 is detected, at block 116 the processor 60 assigns a coordinate value of (X=−K, Y=−A) to this detection point. Relatively simultaneously with the execution of block 116, and as shown in blocks 120 and 124, the sensor 30 is moved in the positive X direction along the line characterized by the equation Y=−A to Sensor Detection Vector 2, wherein the processor 60 starts a Negative Slope Detection timer. The Negative Slope Detection timer encompasses the time in which it would be expected for a second leading edge point 27 of a shipping tube 20 with a negative slope to intersect Sensor Detection Vector 2. Thus, the duration of the Negative Slope Detection timer is a function of the expected tube length, the maximum skew angle and the velocity at which items are transported in the Y axis direction by the transport apparatus.

At block 128, if a second leading edge point 27 is detected at Sensor Detection Vector 2, indicative of a shipping tube having a negative slope, the processor 60 assigns a coordinate value of (X=K, Y=−B) to this point at block 200, as shown in FIG. 5B. (As described above, a Trailing Edge Alarm timer may be set at this point). When a second trailing edge point 28 is detected at block 204, the processor assigns a coordinate value of (x=K, Y=−C) at block 208.

If, however, at blocks 128 and 132 of FIG. 5A, a second leading edge point 27 is not detected before the expiration of the Negative Slope timer, such nondetection being indicative of a shipping tube 20 having a positive slope, the processor 60 signals the X-Y location controller 50 to move the sensor 30 along the line characterized by the equation X=K (i.e, the Sensor Detection Vector 2) in the positive Y direction, as shown in block 300. As shown in block 304, the sensor continues to scan or detect proximity changes as the sensor is moved. When the sensor 30 detects the second trailing edge point 28, the processor 60 assigns a coordinate value (X=K, Y=D) to this point at block 308. Similarly, when the sensor 30 detects a second leading edge point 27 at block 312, the processor 60 assigns a coordinate value of (X=K, Y=E) at block 316.

Calculating the Slope

Referring now to blocks 350 and 250 of FIGS. 5A and 5B respectively, the processor 60 determines the midpoints of the lines formed by the first leading and trailing edge points 25, 26 and by the second leading and trailing Edge points 27, 28, respectively. For a negatively sloping shipping tube, the midpoint of the line formed by the first leading and trailing edge points 25, 26 is (X=−K, Y=(0−A)/2) and the midpoint of the line formed by the second leading and trailing edge points 27, 28 is (X=K, Y=(−A−B)/2). For a positively sloping shipping tube, the midpoint of the line formed by the first leading and trailing edge points 25, 26 is (X=−K, Y=(0−A)/2) and the midpoint of the line formed by the second leading and trailing edge points 27, 28 is (X=K, Y=(D−E)/2). In blocks 350 and 250, the processor 60 calculates the slope of the negatively or positively sloping shipping tube 20 from these midpoints. The slope of the negatively sloping tube is −B/4K. The slope of the positively sloping tube is (A+D)/4K.

Positioning the Sensor Towards an End Point of the Tube

Referring now to blocks 354 and 254, the sensor 30 moves to the midpoint of the line formed by the second leading and trailing edge points 27, 28. Next, in block 258, if the shipping tube 20 is negatively sloped, the sensor 30 moves in a positive X and negative Y direction along the calculated slope of the shipping tube 20 to a position where it would be expected for the endpoint of a shipping tube 20 having a maximum midpoint displacement b to be positioned. This position is the extreme distance from the Y axis that the sensor 30 may be moved to in the positive X direction. This position is on the line characterized by the equation X=MAX and generally will coincide with a lateral edge of the transport apparatus. Similarly, in block 358, if the shipping tube 20 is positively sloped, the sensor 30 moves in a positive X and a positive Y direction along the calculated slope of the tube to a position on the line characterized by the equation X=MAX. In either case, the sensor 30 has now gathered enough data in memory map 66 to scan the entire length of the shipping tube 20 along the slope of the tube.

Scanning the Shipping Tube

In the embodiment shown in FIGS. 1D–1F, the linear array of IC chips to be counted is configured in a simple pattern; they are in a single line (or one dimensional array) with the discriminating aspect of each chip located equidistant from the leading and trailing edges 22,24 of the tube 20. Thus, the line to be scanned to count the discriminating aspects is the center line of the tube, already identified by the slope line calculation.

In block 500, for a negatively sloped shipping tube 20, the sensor 30 is now moved in a negative X and positive Y direction along the slope of the shipping tube 20. Similarly, in block 400, for a positively sloped shipping tube 20, the sensor 30 is moved in a negative X and negative Y direction along the slope of the shipping tube 20.

Referring now to FIG. 5C, as the sensor 30 is moved along the slope of the shipping tube 20, the sensor output signal 36 will represent the various relative proximity differences shown in FIG. 4B. The sensor output signal 36 is evaluated by the level discriminator 63. At block 504, when the level discriminator 63 determines that an increase or decrease in the relative proximity to the sensor 30 corresponding to a height differential between the upper surface 6 of an IC chip and the recessed portion 12 of an IC chip has occurred, the processor 60 will increment the item counter 73 at block 508. As such, and as shown in block 512, the sensor may scan along the slope of the shipping tube 20 to a position along the line X=−MAX. In this manner, the entire length of the shipping tube is scanned and the discriminating aspect (i.e., the distance D between the upper surface 6 and the recessed portion 12) of each and every IC chip is presented to the detection zone of the sensor 30.

Additionally, when the sensor 30 reaches a position along the line X=−MAX, the sensor 30 may then be moved to a position along the Sensor Detection Vector 1 to begin detection of the first leading edge point of the next shipping tube 20.

If desired, information on the motion of the sensor 30 and the detection of discriminating aspects can be processed to determine the length of each IC chip scanned and the overall length of the shipping tube 20. This may be useful in determining what kinds of chips have been scanned in situations where the shipping tubes 20 may not contain the same kind or size of chips.

Second Embodiment

Figures 6A, 6B, 6C:
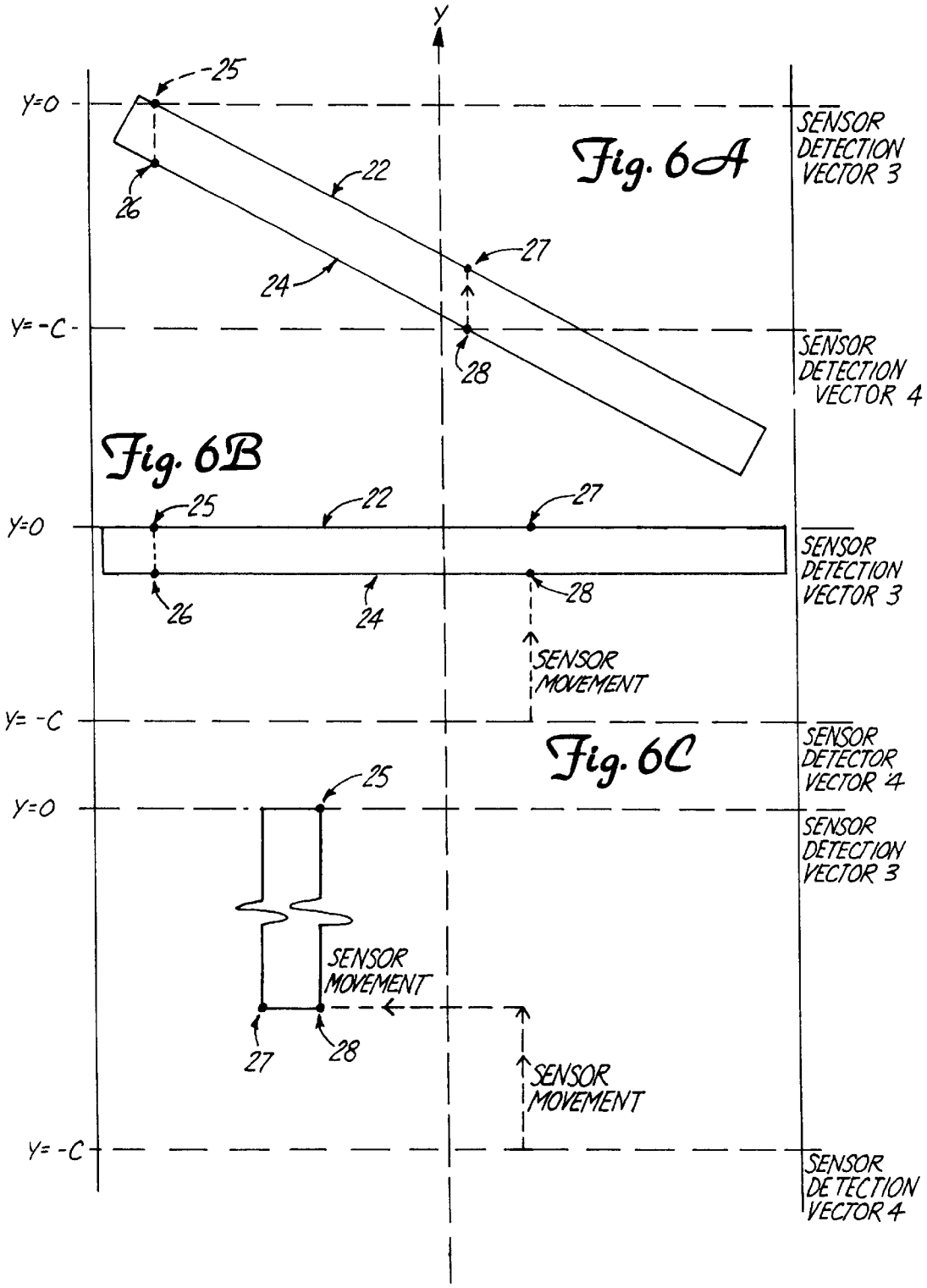
FIGS. 6A–C are top views of a shipping tube being conveyed in an X-Y plane with differing orientations relative to the direction of conveyance.

Referring now to FIGS. 6A–C and 7A–B, a second embodiment of the invention will be described. In this embodiment, in order to determine two points on the linear array formed by the shipping tube 20, the sensor 30 is moved along Sensor Detection Vectors 3 and 4, as shown in FIGS. 6A–C.

Figure 7A:
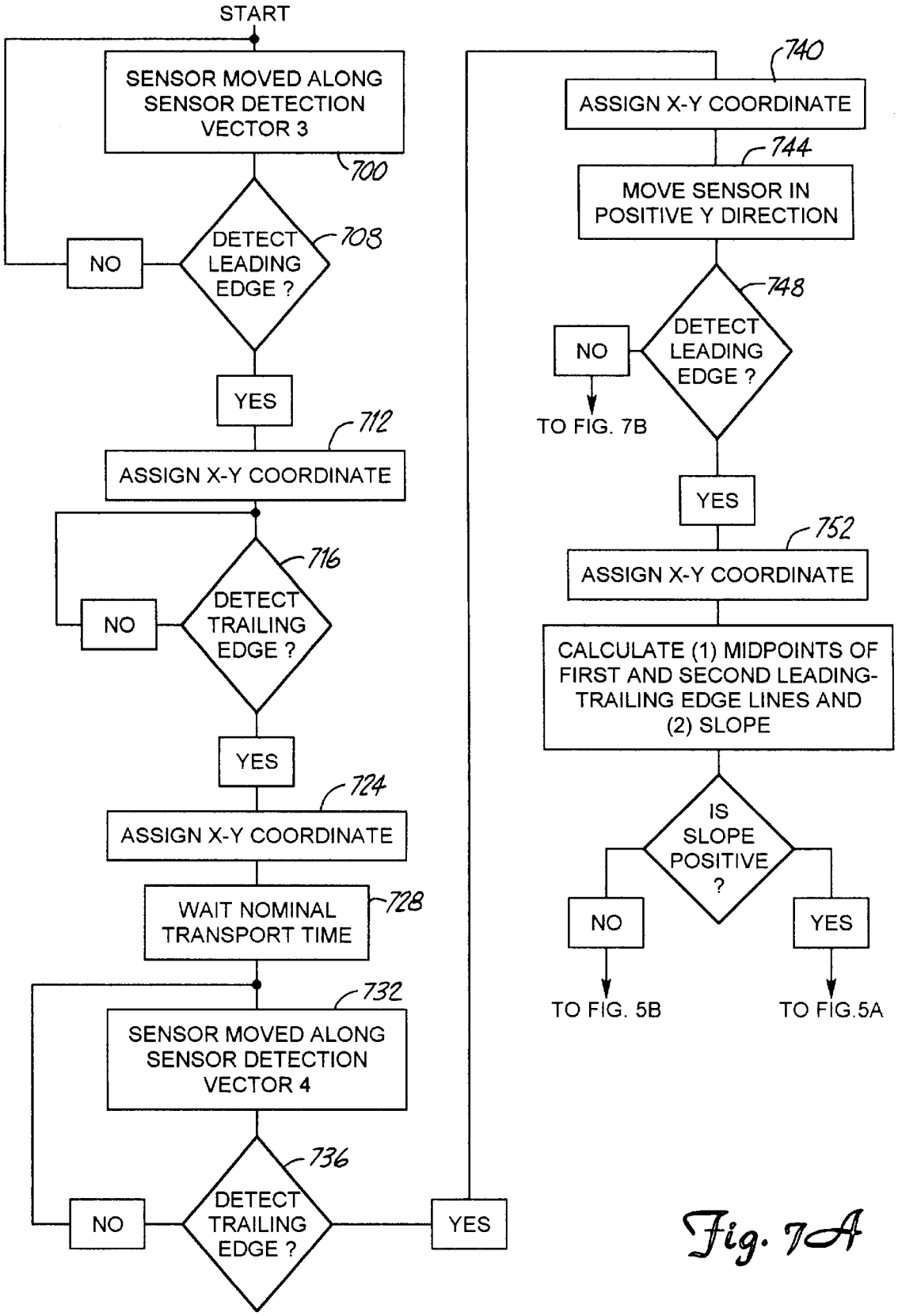
FIGS. 7A–B are flow charts detailing the process for counting IC chips for another embodiment of the present invention.

In this embodiment, as shown in block 700 of FIG. 7A, the sensor 30 is alternately moved in a positive and negative X direction along the line defining Sensor Detection Vector 3 and characterized by the equation Y=0. The sensor 30 alternately moves in the positive and negative X directions until it reaches the respective lateral edge of the scanning station 39 at which point the sensor 30 changes directions. (These lateral edges are characterized by lines having the equations X=MAX and X=−MAX respectively).

It can be seen in FIG. 6A and block 708 of FIG. 7A that as a shipping tube 20 is conveyed by the transport apparatus in the positive Y direction, the sensor 30 moving along Sensor Detection Vector 3 will detect a first leading; edge point 25. At block 712, the processor 60 then assigns a coordinate value in the relative X-Y plane to this point of (X=K, Y=O), where K may be positive or negative. After detection of the first leading edge point 25 the sensor 30 stops moving along Sensor Detection Vector 3 and waits until the first trailing edge point 26 of the shipping tube 20 is detected at block 716. The processor 60 assign a memory map 66 coordinate value of (X=K, Y=−A) to this point at block 724.

In contrast to the first embodiment, at block 728 after detection of the first leading and trailing edge points 25, 26, the sensor 30 now waits in its current position relative to the transport bed 41 for a nominal time period. In block 732, at the expiration of the nominal time period, the sensor 30 is positioned on Sensor Detection Vector 4 which is characterized by the equation Y=−C. At this point the sensor again alternately moves in the positive and negative X directions until the second trailing edge 28 is detected at block 736. When the second trailing edge 28 is detected, at block 740 the processor 60 assigns a memory map 66 Coordinate value to this point of (X=L, Y=−C), wherein L may be positive or negative. At block 744, the sensor moves in the positive Y direction along the line characterized by the equation X=L. When the second leading edge 27 is detected at block 748, a memory map 66 coordinate value of (X=L, Y=−B) is assigned to this point at block 752. The sensor 30 has now gathered enough data in the memory map 66 to determine whether the slope of the linear array formed by the shipping tube 20 is positive or negative, to calculate the slope, and scan the shipping tube 20 as described in the first embodiment.

It can be seen that in the second embodiment of the invention, the first and second leading and trailing edge points 25, 26, 27 and 28 necessary to determine the slope of the linear array will intersect the respective Sensor Detection Vectors 3 and 4 for all possible orientations of the linear array. However, the counting of parts in two specific orientations of a linear array warrant further description, because these two specific orientations may require additional actions by the processor 60 and additional movements and detections by the sensor 30.

Referring to FIGS. 6B–C, the shipping tube 20 is shown oriented in two "extreme" positions for purposes of detecting the first and second leading and trailing edge points 25, 26, 27 and 28. In FIGS. 6B–C, the shipping tube 20 is oriented such that the slope of the linear array formed by the shipping tube 20 is substantially equal to zero and infinity, respectively. It can be seen that in both of these orientations, the second leading and trailing edge points 27, 28 will not be detected when the sensor 30 is moved along Sensor Detection Vector 4. When the linear array formed by the shipping tube 20 has a slope substantially equal to zero, the second trailing edge point 28 will have been transported past Sensor Detection Vector 4 before the sensor 30 is moved along the Sensor Detection Vector 4. In other words, the detection of the trailing edge point 28 will not occur at block 736. Similarly, when the linear array formed by the shipping tube 20 has a slope substantially equal to infinity, the second trailing and leading edge points 27, 28 will not be detected when the sensor 30 is moved along Sensor Detection Vector 4. In this case, the processor 60 will temporarily, incorrectly map the second trailing edge 28 as the first trailing edge 26, as shown in FIG. 6C and block 724. Again, the detection of the trailing edge point 28 will not occur at block 736.

Figure 7B:
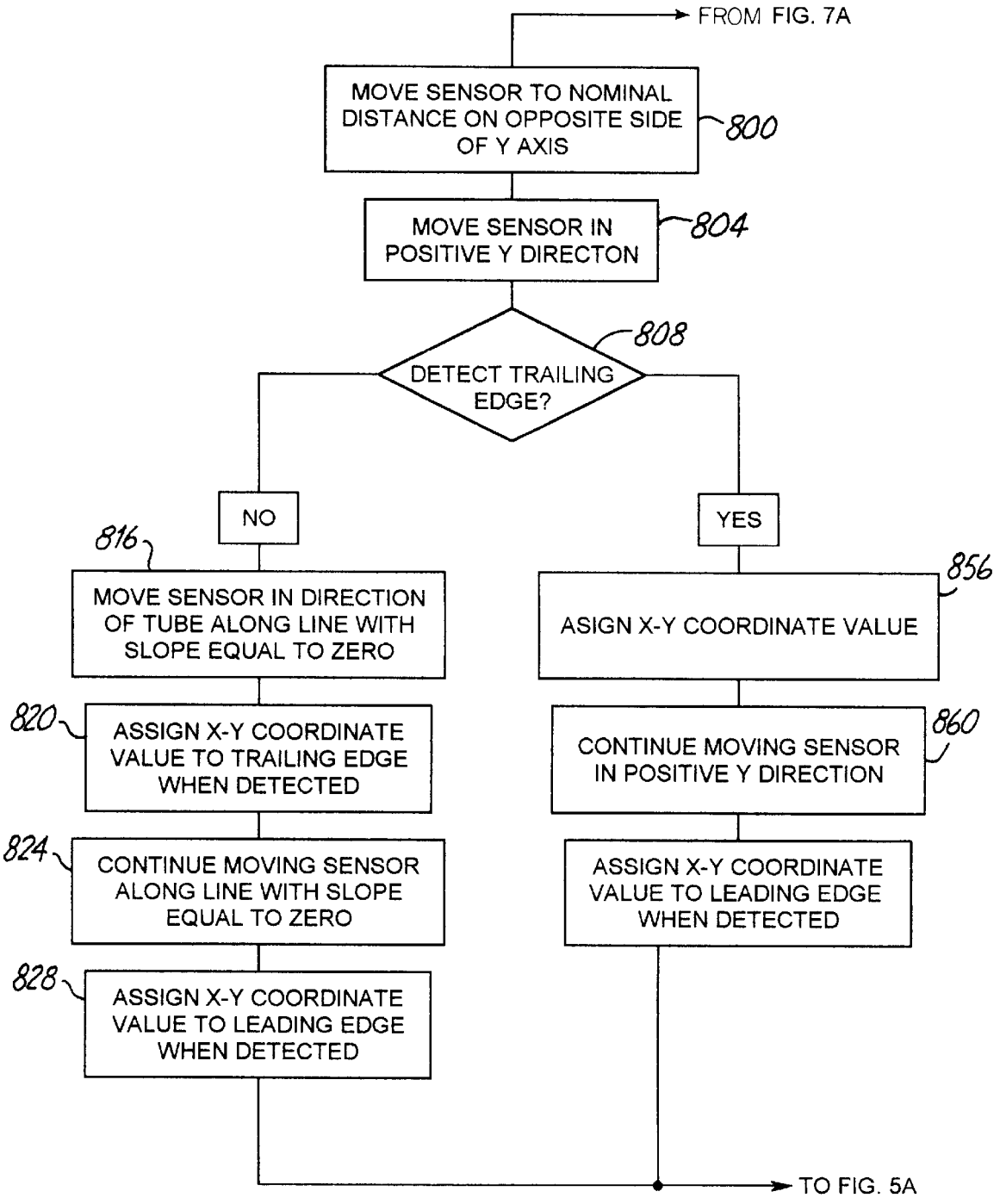

However, as shown in FIG. 7B, the processor 60 will implement a routine if a second trailing edge 28 is not detected at block 736 of FIG. 7A. In block 800 of FIG. 7B, the sensor 30 stops alternately moving in a positive and negative X direction and is moved to a nominal distance on the opposite side of the Y axis from the first leading edge point 25. In block 804, the sensor 30 is moved in the positive Y direction to a point on the line characterized by the equation Y=−A, i.e., the lines corresponding to the Y coordinate of the first trailing edge 26 and the point where it would be expected for the second trailing edge 28 of a linear array with slope substantially equal to zero to be located. In block 808, if the second trailing edge point 28 is not detected at a point on the line characterized by the equation Y=−A, at block 816 the sensor 30 is moved along the line characterized by the equation Y=−A in the known direction of the shipping tube 20. At this point, it is known that the linear array formed by the shipping tube 20 has an substantially infinite slope. In block 820, when the second trailing edge 28 is detected, the processor 60 assigns an X-Y coordinate value at block 820, and continues traveling in the same direction until the second leading edge point 27 is detected and an X-Y coordinate value is assigned at block 828. Given that for this specific orientation of the linear array, the midpoints of the lines formed by the first leading and trailing edge points 25, 26 and the second leading and trailing edge points 27, 28 will have the same X coordinate, only the midpoint of the line formed by the second leading and trailing edge points 27 and 28 need be determined. At this point, the counting of the IC chips may proceed as in the first embodiment.

If the second trailing edge point 28 is detected at block 808, the processor 60 assigns an X-Y coordinate to the second trailing edge point 28 at block 856. At this point, it is known that the linear array formed by the shipping tube 20 has a slope substantially equal to zero. In block 860, the sensor 30 continues traveling in the positive Y direction until the second leading edge point 27 is detected and an X-Y coordinate assigned at block 864. At this point, the counting of the IC chips may proceed as in the first embodiment.

From the foregoing description, it will be apparent that modifications can be made to the apparatus and method described herein without departing from the teachings of the present invention. For example, the Sensor Detection Vectors 1 and 2 may be along the lines characterized by the equations Y=K and Y=−K, respectively. Additionally, various timers and tolerances may be used for various alarm conditions, such as a skew angle exceeding maximum tolerances, stoppage of the transport apparatus, etc.

Additionally, while the above embodiments have been described as detecting and counting parts in a linear array of chips that is formed by a single straight line of abutting chips within a tube 20, it will be apparent that the above embodiments may be modified to count chips in a linear array having two or more straight lines of abutting chips (i.e., a linear array with two dimensions), or having chips in some predetermined pattern that does not consist of straight lines parallel to the slope determined for the linear array as a whole. In such multi-line or non-straight line arrays, the sensor 30 will still gather information representing the relative orientation of the linear array of IC chips in the X-Y plane, yielding a slope for the linear array as a whole. The information representing the relative orientation of the linear array may include not only the slope but also a plurality of X-Y coordinate points detected by the sensor 30 on the lines defining the outer dimensions of the linear array. Once the orientation of the linear array in the X-Y plane is determined, in order to count the IC chips within it, the sensor 30 may make one or more scans of the linear array, in whatever predetermined pattern has been programmed into the processor 60. Thus, in addition to the relatively simple patterns whereby the tube 20 holds chips in a single line or a double line, the sensor 30 can be driven to scan any predetermined pattern falling within the existing linear array. The exact pattern followed will depend on the predetermined placement pattern for chips within the tube 20 and the predetermined location of discriminating aspects on those chips and also depend upon the previously determined dimensions of the array. The scans are appropriately predetermined to cover each location at which a discriminating aspect of a chip may appear.

Accordingly, the scope of the invention is only limited as necessitated by the accompanying claims.

I claim:

1. A method for counting a plurality of objects, wherein the objects are aligned such that the objects form a linear array within an X-Y plane, wherein a scanning station is defined within the X-Y plane, and wherein the linear array has a slope within the X-Y plane, comprising:

(a) determining the slope of the linear array;

(b) scanning a predetermined pattern within the linear array; and (c) detecting individual objects within the linear array as the linear array is scanned.

2. The method of claim 1 wherein the linear array of objects has a width such that when the linear array of objects is conveyed through the scanning station, the linear array of objects has a leading edge and a trailing edge, and wherein the act of determining the slope of the linear array comprises:

(a) detecting a first leading edge point and a first trailing; edge point, (b) detecting a second leading edge point and a second trailing edge point, (c) determining the midpoints of line segments defined by the first leading and trailing edge points and the second leading and trailing edge points respectively, and (d) calculating the slope of the linear array from the midpoints of the line segments defined by the first leading and trailing edge points and the second leading and trailing edge points, respectively.

3. The method of claim 2 wherein the absolute value of the slope of the alignment of objects has a maximum value, and wherein the act of determining the slope of the linear array further comprises:

(a) positioning a sensor such that the first leading and trailing edge points may be detected, ( b) positioning the sensor relative to the scanning station such that if the linear array has a maximum negative slope, the second leading and trailing edges may be detected as the linear array of objects is conveyed through the scanning station, (c) starting a timer with a duration encompassing the expected time in which the leading edge of an alignment of objects with a maximum negative slope would be detected by the sensor, and (d) moving the sensor in an increasing Y direction along a line wherein X is equal to the second X coordinate until the second trailing and leading edges are detected if the second leading and trailing edges are not detected during the duration of the timer.

4. The method of claim 1 further comprising conveying the linear array of objects through the scanning station, wherein the linear array of objects is conveyed in a direction defined by the Y axis of the X-Y plane.

5. The method of claim 1 further comprising transporting the linear array of objects on a transport bed relative to a sensor and transporting the sensor at a rate of speed at least an order of magnitude higher than the transport speed of the transport bed.

6. The method of claim 1 wherein the act of detecting comprises sensing a discriminating aspect of the individual objects as the linear array is scanned.

7. The method of claim 6 wherein the individual objects are IC chips having an upper surface and a recessed portion of the upper surface and wherein the discriminating aspect of an IC chips is the recessed portion of the upper surface of the IC chip.

8. The method of claim 6 wherein the discriminating aspect of an individual object is a relative change in proximity of a portion of the object.

9. The method of claim 2 wherein the act of calculating the slope of the linear array comprises assigning X-Y plane coordinates to the detected and determined points.

10. The method of claim 9 wherein the act of calculating the slope of the linear array comprises storing the X-Y plane coordinates in a memory map.

11. The method of claim 1 wherein the act of scanning a predetermined pattern within the linear array comprises scanning along a single straight line following the slope of the linear array, substantially on a center line of the linear array.

12. The method of claim 2 wherein the act of detecting comprises directing light from a sensor to an object and directing light from the object to the sensor.

13. The method of claim 2 wherein the act of detecting comprises moving a sensor in the X-Y plane.

14. A method for counting a plurality of objects, wherein the objects are aligned such that the objects form a linear array oriented an X-Y plane, comprising:

(a) determining the orientation of the linear array;

(b) scanning the linear array; and (c) detecting individual objects within the linear array as the linear array is scanned.

15. The method of claim 14 further comprising conveying the linear array of objects in a direction defined by the Y axis of the X-Y plane.

16. The method of claim 14 further comprising transporting the linear array of objects on a transport bed relative to a sensor and transporting the sensor at a rate of speed at least an order of magnitude higher than the transport speed of the transport bed.

17. The method of claim 14 wherein the act of determining the orientation of the array comprises detecting a plurality of points on the array such that the outer dimensions of the array may be determined.

18. The method of claim 17 wherein the act of determining the orientation of the array further comprises assigning X-Y plane coordinates to the detected points.

19. The method of claim 18 wherein the act of determining the orientation of the array further comprises storing the X-Y plane coordinates in a memory map.

20. The method of claim 14 wherein the act of detecting comprises sensing a discriminating aspect of the individual objects as the linear array is scanned.

21. The method of claim 20 wherein the individual objects are IC chips having an upper surface and a recessed portion of the upper surface and wherein the discriminating aspect of an IC chips is the recessed portion of the upper surface of the IC chip.

22. The method of claim 20 wherein the discriminating aspect of an individual object is a relative change in proximity of a portion of the object.

* * * * *